US008113610B2

(12) United States Patent
Nishizaka

(10) Patent No.: US 8,113,610 B2
(45) Date of Patent: Feb. 14, 2012

(54) FLUID EJECTION DEVICE AND MOUNTING POSITION DETERMINATION METHOD

(75) Inventor: Katsuhiko Nishizaka, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 409 days.

(21) Appl. No.: 12/319,237

(22) Filed: Jan. 5, 2009

(65) Prior Publication Data

US 2009/0174744 A1 Jul. 9, 2009

(30) Foreign Application Priority Data

Jan. 4, 2008 (JP) ..... 2008-000093

(51) Int. Cl.
*B41J 29/38* (2006.01)
*B41J 21/16* (2006.01)

(52) U.S. Cl. ..... 347/5; 347/9; 400/708

(58) Field of Classification Search ..... 347/5, 9, 347/14; 400/708
See application file for complete search history.

(56) References Cited

U.S. PATENT DOCUMENTS 5,397,192 A * 3/1995 Khormaee ..... 400/708

FOREIGN PATENT DOCUMENTS

| | | |
|---|---|---|
| JP | 2004-090316 | 3/2004 |
| JP | 2005-138337 | 6/2005 |
| JP | 2007-098759 | 4/2007 |
| JP | 2007-216670 | 8/2007 |

* cited by examiner

*Primary Examiner* — Lam S Nguyen
(74) *Attorney, Agent, or Firm* — Nutter McClennen & Fish LLP; John J. Penny, Jr.

(57) ABSTRACT

An output voltage of a paper-width detector is input while a carriage is moved leftward in a main scan direction. Whether a mounting position of a test element member in the main scan direction falls within a generally horizontal design basis range is determined based on the position of the carriage and reference information. The position of the carriage in the main scan direction is determined from a signal of a linear encoder when a right edge of the test element member is detected in response to a substantial change in the output voltage of the paper-width detector. Whether a mounting position of the test element member in a substantially vertical direction falls within a vertical design basis range is determined based on the mounting position of the test element member in the substantially vertical direction determined from the output voltage of the paper-width detector and the reference information.

6 Claims, 5 Drawing Sheets

| MEMBER NAME | ORDER | THRESHOLD VALUE(V) | HORIZONTAL DESIGN BASIS RANGE | | VERTICAL DESIGN BASIS RANGE | |
|---|---|---|---|---|---|---|
| | | | HORIZONTAL LOWER LIMIT(mm) | HORIZONTAL UPPER LIMIT(mm) | VERTICAL LOWER LIMIT(V) | VERTICAL UPPER LIMIT(V) |
| WIPER | 1 | Vref1 | DL1 | DU1 | HL1 | HU1 |
| PLATEN | 2 | Vref2 | DL2 | DU2 | HL2 | HU2 |
| BLOTTER | 3 | Vref3 | DL3 | DU3 | HL3 | HU3 |
| FLUSHING MEMBER | 4 | Vref4 | DL4 | DU4 | HL4 | HU4 |

| MEMBER NAME | ORDER | THRESHOLD VALUE(V) | HORIZONTAL DESIGN BASIS RANGE | | VERTICAL DESIGN BASIS RANGE | |
|---|---|---|---|---|---|---|
| | | | HORIZONTAL LOWER LIMIT(mm) | HORIZONTAL UPPER LIMIT(mm) | VERTICAL LOWER LIMIT(V) | VERTICAL UPPER LIMIT(V) |
| WIPER | 1 | Vref1 | DL1 | DU1 | HL1 | HU1 |
| PLATEN | 2 | Vref2 | DL2 | DU2 | HL2 | HU2 |
| BLOTTER | 3 | Vref3 | DL3 | DU3 | HL3 | HU3 |
| FLUSHING MEMBER | 4 | Vref4 | DL4 | DU4 | HL4 | HU4 |

82

| TEST RESULTS | | |
|---|---|---|
| MEMBER NAME | MAIN SCAN DIRECTION | UP-DOWN DIRECTION |
| WIPER | PASSED | PASSED |
| PLATEN | FAILED | PASSED |
| BLOTTER | PASSED | PASSED |
| FLUSHING MEMBER | PASSED | PASSED |
| IT IS HIGHLY LIKELY THAT PW SENSOR AND CARRIAGE ARE ASSEMBLED AT NORMAL MOUNTING POSITIONPW | | |

FIG. 7

82

| TEST RESULTS | | | |
|---|---|---|---|
| MEMBER NAME | MAIN SCAN DIRECTION | UP-DOWN DIRECTION | OPERATION |
| CAP | — | — | PASSED |
| WIPER | PASSED | PASSED | — |
| PLATEN | FAILED | PASSED | — |
| BLOTTER | PASSED | PASSED | — |
| FLUSHING MEMBER | PASSED | PASSED | — |
| IT IS HIGHLY LIKELY THAT PW SENSOR AND CARRIAGE ARE ASSEMBLED AT NORMAL MOUNTING POSITION | | | |

FLUID EJECTION DEVICE AND MOUNTING POSITION DETERMINATION METHOD

BACKGROUND OF THE INVENTION

1. Field of the Invention

This invention relates to a fluid ejection device and a mounting position determination method.

2. Description of the Prior Art

In a typical known ink jet recording device, a sensor is arranged on a recording head, and detects an edge of a recording paper sheet on a platen when the recording head moves in a main scan direction with the sensor facing the platen. For example, Patent Document 1 discloses an ink jet recording device. The disclosed ink jet recording device includes a reflective-type photo-interrupter composed of a light emitter unit including a light-emitting diode and a light receiver including a photo-transistor. The photo-interrupter is arranged upstream of the recording head in a sub scan direction. Light emitted from the light emitter unit is received by the light receiver and an output voltage of the light receiver changes in response to the level of the received light. The ink jet recording device detects an edge of a recording sheet based on a difference between the light level of the light reflected from the recording sheet and the light level of the light reflected from the platen. [Patent Document 1] Japanese Unexamined Patent Application Publication No. 2004-90316

SUMMARY OF THE INVENTION

Such an ink jet recording device is manufactured by pre-assembling components into an assembly, and then by assembling a plurality of assemblies into a finished ink jet recording device. An assembly error of each component and a assembly error of the device may be summed. Even if each component is pre-assembled within a permissible assembly error range (design basis range), a mounting position of an assembly, when assembled into the final device, may fall out of the design basis range. If an unintentional impact is applied to the device in the course of delivery or because of the aging of the device, the device may fall finally out of the design basis range even though the device was set within the design basis range. Since the device can still print in such a case, the user may not notice such an irregularity. The ink jet recording device disclosed in Patent Document 1 can determine whether a mounting position of the element member falls within the design basis range by installing a dedicated mechanism for detecting a mounting error. With such a dedicated mechanism introduced, the device becomes complicated in structure, enlarged in size, and expensive in cost.

It is an object of the present invention to provide a fluid ejection device and a mounting position determination method for determining without any dedicated mechanism whether a mounting position of a predetermined element member forming a device falls within a design basis range.

The present invention has adopted the following module to achieve the above object.

A fluid ejection device of the present invention includes:

an ejection module for ejecting a fluid;

an edge detection module for detecting an edge of a target based on a variation in an output voltage in response to the presence or absence of the target on a platen;

a carriage module for mounting the ejection module and the edge detection module and moving the ejection module and the edge detection module in the predetermined direction while causing the ejection module to eject the fluid onto the target;

a memory module for storing information regarding a design basis range of a mounting position of a predetermined element member provided within a detection coverage area of the edge detection module; and a determination module for controlling the edge detection module and the carriage module to detect the edge of the element member when an instruction to measure the mounting position of the element member is issued and determining, based on the output voltage of the edge detection module and the information regarding the design basis range stored on the memory module, whether a mounting position of the element member falls within the design basis range.

When the instruction to measure the mounting position of the element member is issued in the fluid ejection device, the determination module controls the edge detection module and the carriage module to detect the edge of the element member. On the basis of the output voltage of the edge detection module and the information regarding the design basis range stored on the memory module, the determination module determines whether a mounting position of the element member falls within the design basis range. In response to the instruction to measure the element member, the edge detection module for detecting the edge of the target is used to determine whether the mounting position of the element member falls within the design basis range. The determination as to whether the mounting position of the predetermined element member forming the device falls within the design basis range is preformed without using any dedicated mechanism. The predetermined element members may include a wiper for removing a fluid remnant sticking to the ejection module, a cap closing the ejection module, a blotter blotting the fluid ejected and landed off the target, a flushing member ejecting an ink drop to prevent the fluid from solidifying at the ejection module, and a platen.

In the fluid ejection of the present invention, the memory module may store, as the information regarding the design basis range, information regarding the design basis range of the mounting position of the element member in the predetermined direction, and the determination module may measure the mounting position of the element member in the predetermined direction based on the output voltage of the edge detection module and an amount of movement of the carriage module, and determines, based on the measured mounting position and the design basis range stored on the memory module, whether the mounting position of the element member falls within the design basis range. With this arrangement, a position error of the element member in the predetermined direction is recognized.

In the fluid ejection device, the memory module may store, as the information regarding the design basis range, information regarding the design basis range of the mounting position of the element member in a direction substantially perpendicular to the predetermined direction, and the determination module may measure the mounting position of the element member in the direction substantially perpendicular to the predetermined direction based on the output voltage of the edge detection module and an amount of movement of the carriage module, and determine, based on the measured mounting position and the design basis range stored on the memory module, whether the mounting position of the element member falls within the design basis range. With this arrangement, a position error of the element member in the direction substantially perpendicular to the predetermined direction is recognized. The mounting position may be represented by an output voltage of the edge detection module.

The fluid ejection device may further include a notification module for notifying a user of the determination results of the determination module.

In the fluid ejection device, the determination module may determine whether mounting positions of a plurality of element members fall within the design basis ranges thereof, and determine that at least one of the mounting position of the carriage module and the mounting position of the edge detection module with respect to the carriage module is likely to fall out of the design basis range if all the determined members are shifted out of the design basis range. With this arrangement, whether at least one of the mounting position of the carriage module and the mounting position of the edge detection module with respect to the carriage module falls out of the design basis range is determined without using any dedicated mechanism.

The fluid ejection device may include a lifting module for moving the element member in a direction substantially perpendicular to the predetermined direction, and a fault determination module for outputting a command to the lifting module to move the element member in the direction substantially perpendicular to the predetermined direction and determining that the lifting module malfunctions if the output of the edge detection module remains unchanged subsequent to the output of the command. With this arrangement, whether any fault takes place in the lifting module is determined without using any dedicated mechanism.

A mounting position determination method of the present invention is a method of a fluid ejection device of the present invention including an ejection module for ejecting a fluid, an edge detection module for detecting an edge of a target based on a variation in an output voltage in response to the presence or absence of the target on a platen, and a carriage module for mounting the ejection module and the edge detection module and moving the ejection module and the edge detection module in the predetermined direction while causing the ejection module to eject the fluid onto the target, the mounting position determination method including steps of:

controlling the edge detection module and the carriage module to detect the edge of a predetermined element member provided within a detection coverage area of the edge detection module when an instruction to measure a mounting position of the predetermined element member is issued; and determining, based on the output voltage of the edge detection module and information regarding a design basis range of a mounting position of the element member read from memory module, whether the mounting position of the element member falls within the design basis range.

In the mounting position determination method, the edge detection module and the carriage module are controlled to detect the edge of a predetermined element member provided within a detection coverage area of the edge detection module when an instruction to measure a mounting position of the predetermined element member is issue. It is determined whether the mounting position of the element member falls within the design basis member, based on the output voltage of the edge detection module and information regarding a design basis range of the mounting position of the element member read from memory module. With this arrangement, in response to the instruction to measure the element member, the edge detection module for detecting the edge of the target is used to determine whether the mounting position of the element member falls within the design basis range. The determination as to whether the mounting position of the predetermined element member forming the device falls within the design basis range is preformed without using any dedicated mechanism.

BRIEF DESCRIPTION OF THE DRAWINGS

FIG. 7 illustrates an image of other determination results displayed on the liquid-crystal display 82.

DESCRIPTION OF THE PREFERRED EMBODIMENTS

Figure 1:
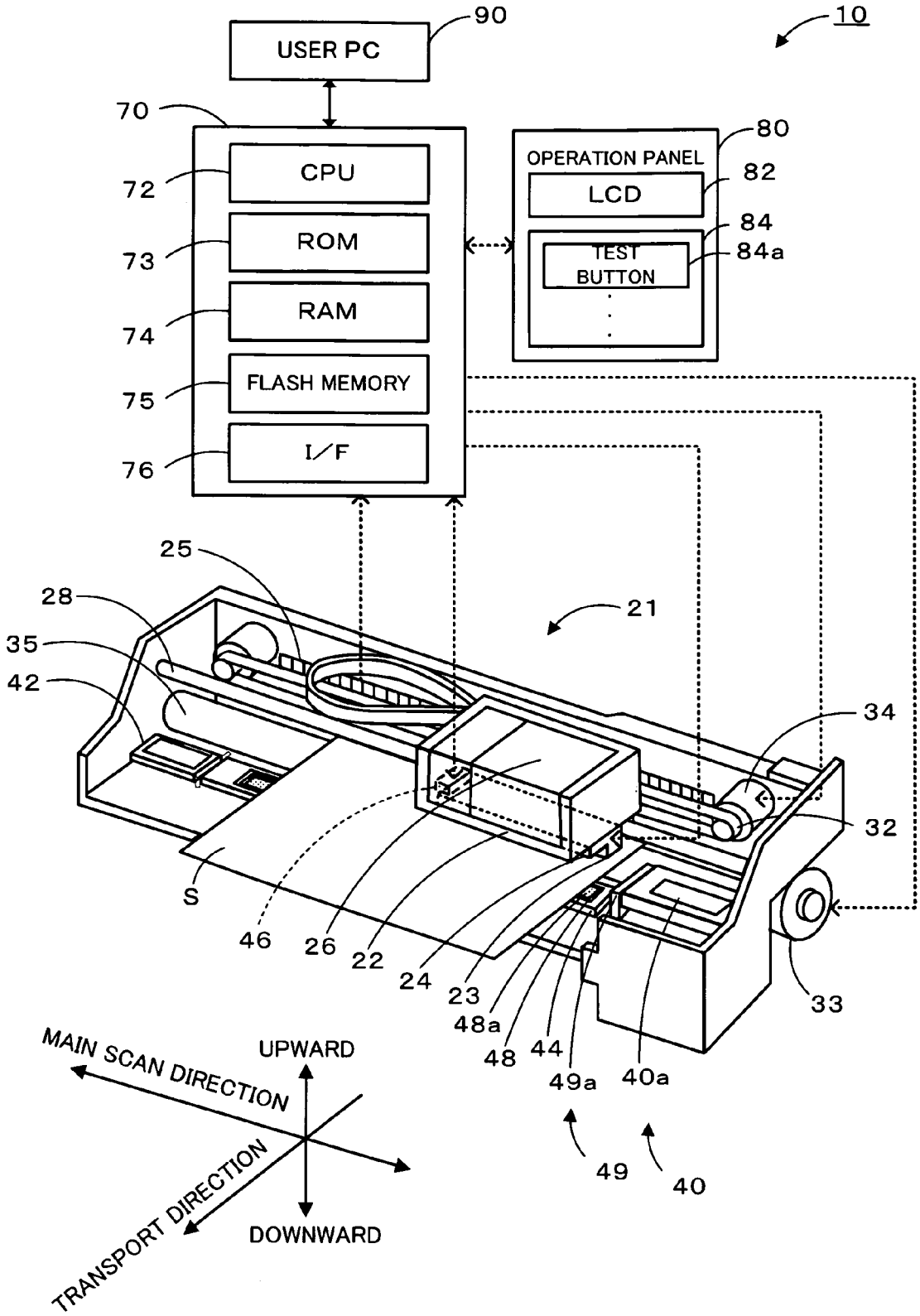
FIG. 1 illustrates a general configuration of an ink-jet printer 10 in accordance with one embodiment of the present invention.
Figure 2:
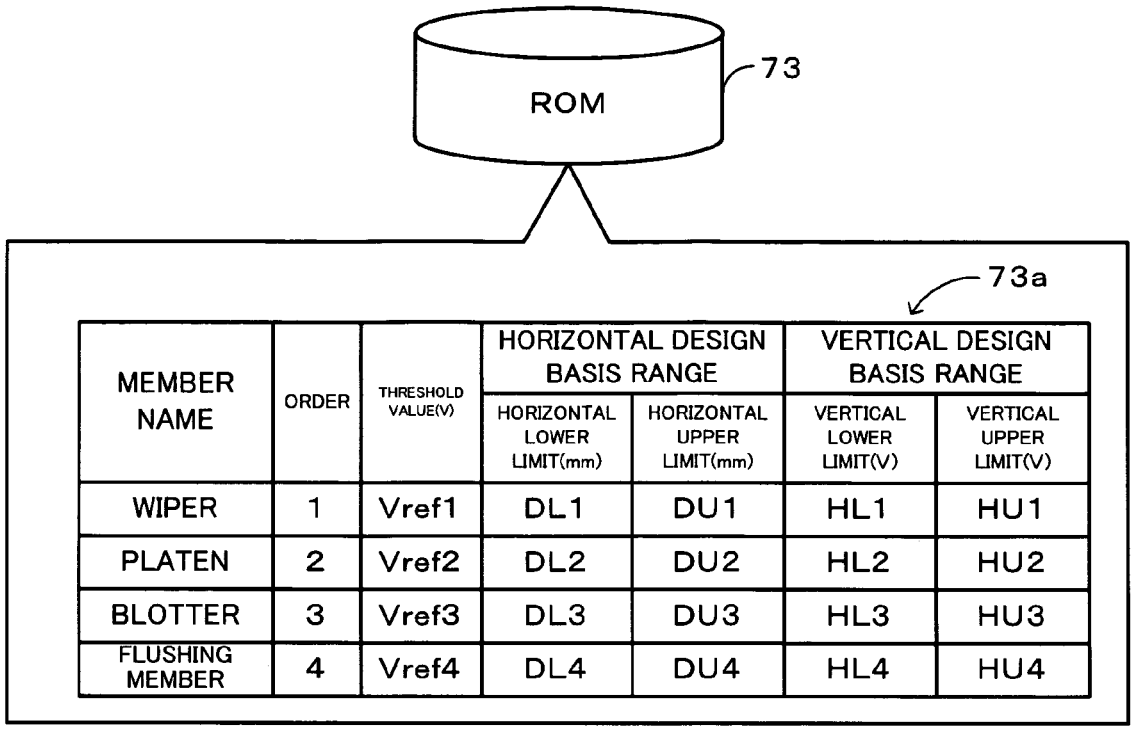
FIG. 2 illustrates reference information 73*a* stored on a read-only memory (ROM) 73.

The embodiments of the present invention are described below with reference to the drawings. FIG. 1 illustrates a generation configuration of an ink-jet printer 10 in accordance with one embodiment of the present invention. FIG. 2 illustrates reference information 73*a* stored on a read-only memory (ROM) 73.

Referring to FIG. 1, the ink-jet printer 10 of the present embodiment includes a platen 44 serving as a support for a paper sheet S, a printer mechanism 21 printing by ejecting ink drops onto the paper sheet S that is carried over the platen 44 from the back to the front by a sheet conveyance roller 35, a paper-width (PW) detector 46, arranged on the left side of a print head 24, for detecting left and right edges of the paper sheet S, a flushing member 42 arranged in the vicinity of the left end of the platen 44, a capping unit 40 arranged in the vicinity of the right end of the platen 44, a wiper unit 49 arranged between the platen 44 and the capping unit 40, a discharge section 48 formed in parallel with the platen 44 in a main scan direction, an operation panel 80 for displaying a variety of information and receiving a variety of instructions from the user, and a controller 70 for controlling the overall the ink-jet printer 10.

The platen 44 is arranged at a position that faces the print head 24 that moves along the main scan direction. The platen 44 supports the paper sheet S so that a predetermined gap is maintained between the paper sheet S and the print head 24.

The printer mechanism 21 includes a drive motor 33 for driving the sheet conveyance roller 35, a carriage 22 that is moved in a reciprocatory fashion in the main scan direction along a guide 28 by a carriage belt 32 and a carriage motor 34, ink cartridges 26, mounted on the carriage 22, and containing separately inks of yellow (Y), magenta (M), cyan (C), and black (B), the print head 24 for pressurizing the inks supplied from the ink cartridges 26 by deforming piezoelectric elements, and a nozzle 23 for ejecting ink drops pressurized by the print head 24. A linear encoder 25 for detecting a position of the carriage 22 is arranged on the back of the carriage 22. The position of the carriage 22 is controlled using the linear encoder 25. The print head 24 may be of a type that applies a voltage on a heating resistor element (such as a heater) to heat ink and pressurizes the ink by bubbles caused by heating.

The PW detector 46 is an optical sensor including a light emitting element (not shown) including a light-emitting diode (LED) for emitting light toward the paper sheet S and a light receiver (not shown) for receiving light reflected from the paper sheet S and outputting a voltage responsive to the light level of the received light. The PW detector 46, arranged on the left side of the print head 24, detects the left and right edges of the paper sheet S while being moved laterally in a reciprocatory fashion. Upon receiving a detection command signal from the controller 70, the PW detector 46 moves laterally in a reciprocatory fashion. Along with the movement of the PW detector 46, the light emitting element emits light to the paper sheet S and the light receiver receives the light reflected from the paper sheet S and sends an output voltage responsive to the light level of the received light to the controller 70. The light receiver has characteristics that the higher the light level of the received light is received, the lower the output voltage becomes. Alternatively, the light receiver may have characteristics that the higher the light level of the received light is received, the higher the output voltage becomes.

The flushing member 42 is arranged at an area leftward out of a printable region of the platen 44 as illustrated in FIG. 1. The flushing member 42 performs a flushing operation. In the flushing operation, ink drops are ejected periodically or at a predetermined timing in a manner not dependent on print data to prevent ink from being dried and solidifying at the tip of the nozzle 23.

The capping unit 40 is arranged on the rightward out of the printable region of the platen 44 as illustrated in FIG. 1. The capping unit 40 is a generally rectangular parallelepiped and includes a cap 40*a* having a top opening and lifted up and down by a cap motor (not shown). While the ink-jet printer 10 is not used, the capping unit 40 closes the print head 24 in order to prevent the print head 24 from being dried. The position right above the capping unit 40 is also referred to a home position.

The wiper unit 49 is arranged to the right of the printable region of the platen 44. The wiper unit 49 includes a wiper member 49*a* made of an elastic material such as a synthetic rubber and supported by a plastic member. The wiper member 49*a* is raised and lowered by a wiper motor (not shown). The wiper unit 49 is used to remove remnant ink sticking to the nozzle 23 and the surrounding area thereof. To remove the remnant ink, the wiper member 49*a* is left at an upper position by the wiper motor (not shown). When the carriage 22 moves leftward in the main scan direction from the home position, the top end of the wiper member 49*a* wipes the underside of the print head 24 mounted on the carriage 22. In this way, the remnant ink sticking to the nozzle 23 and the surrounding area thereof on the underside of the print head 24 is removed.

The discharge section 48 is an elongated area extending in the main scan direction in parallel with the platen 44 and includes a blotting member 48*a* (such as sponge) for blotting ink. The discharge section 48 is used to receive ink ejected off the edge of the paper sheet S, for example, when printing with no outline is performed. The discharge section 48 is shorter than the platen 44 in the main scan direction as shown in FIG. 1.

The operation panel 80 includes a liquid-crystal display 82 for displaying a variety of information in response to a display command signal from the controller 70 and an operation button group 84 for inputting a variety commands when the user presses each button. The operation button group 84 includes a test button 84*a* that is used to input to the ink-jet printer 10 a command to start measurement of a mounting position.

As illustrated in FIG. 1, the controller 70 is configured as a microprocessor centered on a central processing unit (CPU) 72, and includes a read-only memory (ROM) 73 storing a variety of programs such as a print process routine, and a variety of data, a random-access memory (RAM) 74 storing temporarily data, a flash memory 75 allowing data to be written and deleted, an interface (I/F) 76 exchanging data with an external device, and input and output ports (not shown). The controller 70 receives an on-off signal from the test button 84*a*, an output voltage from the PW detector 46, a signal related to a position of the carriage 22 from the linear encoder 25, etc. via input ports (not shown). The controller 70 further receives a print job from a user personal computer 90 via the interface 76. The controller 70 in turn outputs control signals to the print head 24, the drive motor 33, the cap motor, and the wiper motor, a display command signal to the liquid-crystal display 82, a detection command signal to the PW detector 46, etc. via output ports (not shown). The controller 70 further outputs print status information to the user personal computer 90 via the interface 76.

The ROM 73 stores the reference information 73*a* as illustrated in FIG. 2. The reference information 73*a* relates to the design basis range of the mounting position of a test element member such as the wiper member 49*a*, the platen 44, the blotting member 48*a*, or the flushing member 42. More specifically, the ROM 73 stores the order and threshold values of member names, the design basis range in the horizontal direction and the design basis range in the vertical direction.

Figure 3:
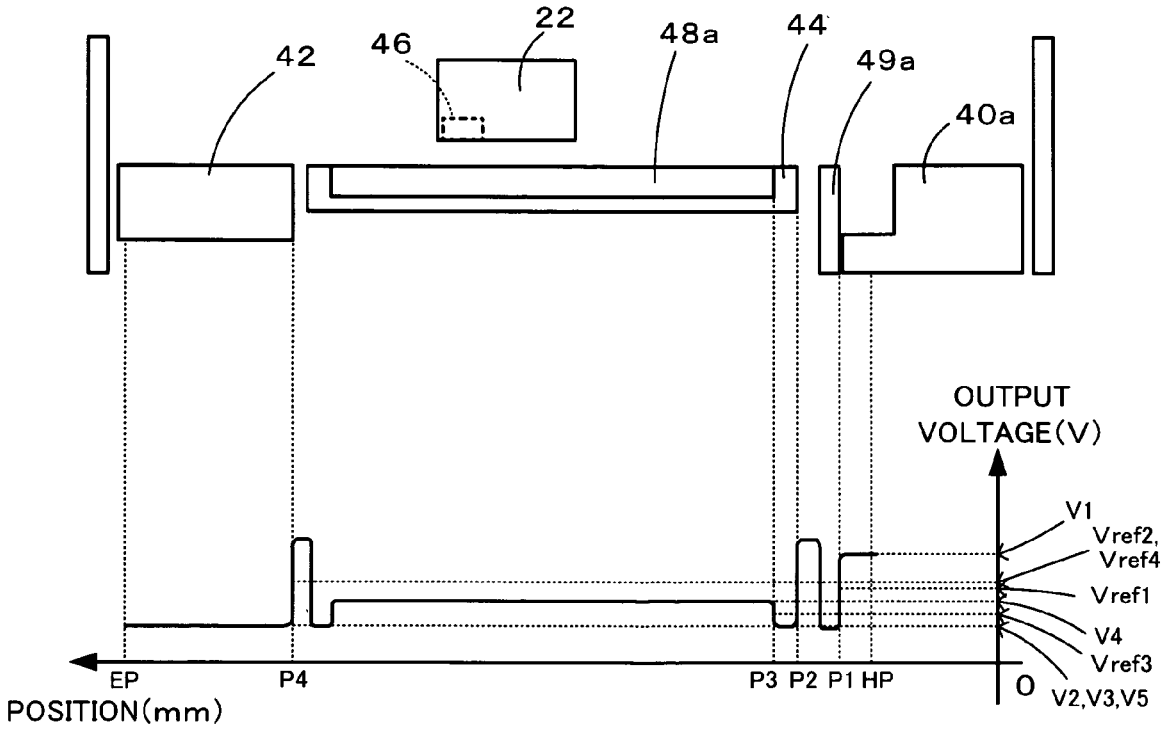
FIG. 3 illustrates an arrangement of test element members and an output voltage from a PW detector 46.

The order of the element member names is an arrangement order of the test element members starting leftward from the home position. FIG. 3 illustrates the arrangement order of the test element members and an output voltage of the PW detector 46. Referring to FIG. 3, in the arrangement order, the wiper member 49*a* is first, the platen 44 is second, the blotting member 48*a* is third, and the flushing member 42 is fourth. As illustrated in FIG. 3, a voltage V1 and a position HP represent the output voltage of the PW detector 46 with the carriage 22 at the home position, and the home position, respectively. Voltages V2-V5 and positions P1-P4 represent, respectively, the output voltages of the PW detector 46 when right edges of the wiper member 49*a*, the platen 44, the blotting member 48*a* and the flushing member 42 are detected, and the right edge positions of the right edges of the wiper member 49*a*, the platen 44, the blotting member 48*a* and the flushing member 42. Referring to FIG. 3, the wiper member 49*a*, the platen 44, the blotting member 48*a* and the flushing member 42 are arranged within a detection coverage range of the PW detector 46, i.e., from the home position HP to position EP representing an end position of the flushing member 42.

The threshold value is empirically determined so that a variation in the output voltage of the PW detector 46 that moves leftward from the home position and passes by the right edge of each test element member is reliably detected. Referring to FIG. 3, the output voltage of the PW detector 46 greatly changes when the PW detector 46 passes by the right edge of each test element member. The voltage change is determined by the position of each test element member in a vertical direction and the quality of the material (reflectance) of each test element member. In accordance with the present embodiment, the change in the output voltage is monitored beforehand at the moment the PW detector 46 passes by each test element member in experiments. A value allowing the right edge of each test element member to be reliably detected and not mistaken for noise is set as a threshold value. More specifically, the output voltage of the PW detector 46 moving leftward from the home position is monitored. When the output voltage decreases and becomes equal to or lower than a threshold value Vref1, the right edge of the wiper member 49*a* is considered to be detected. When the output voltage decreases and becomes equal to or lower than a threshold value Vref2, the right edge of the platen 44 is considered to be detected. When the output voltage then increases and becomes equal to or higher than a threshold value Vref3, the right edge of the blotting member 48*a* is considered to be detected. When the output voltage then decreases and becomes equal to or lower than a threshold value Vref4, the right edge of the flushing member 42 is considered to be detected.

The design basis range in the horizontal direction (the main scan direction) is determined by setting with respect to a design position of the right edge of each test element member, a tolerance within which the device operates without any problem. The design basis range in the horizontal direction extends from a horizontal lower limit to a horizontal upper limit, and is set for each test element member as listed in FIG. 2. The design basis range in the vertical direction (up-down direction) is determined by setting with respect to a design position of the right edge of each test element member in the vertical direction, a tolerance within which the device operates without any problem. The design basis range in the horizontal direction extends from a vertical lower limit to a vertical upper limit, and is set for each test element member as listed in FIG. 2. The lower limit and the upper limit are coordinates with respect to the home position serving as the origin.

Figure 4:
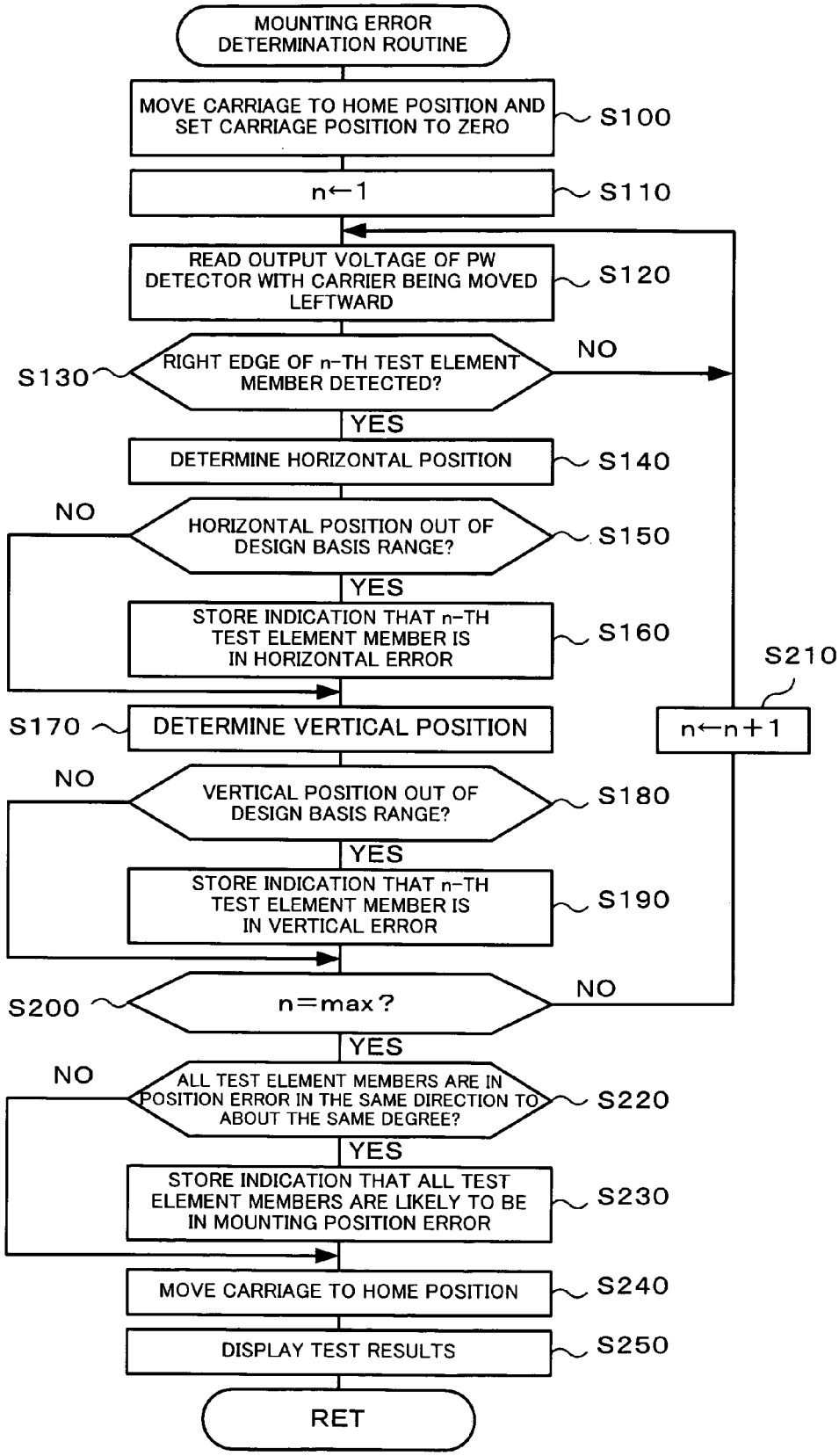
FIG. 4 is a flowchart illustrating a mounting error determination routine.

The operation of the ink-jet printer 10 of the present embodiment thus constructed is described below particularly from the standpoint of determining whether the mounting position of each test element member falls within the design basis range with the PW detector 46 and notifying the user of the determination results. FIG. 4 is a flowchart of an mounting error determination routine. The routine is stored on the ROM 73. When the user presses the test button 84*a*, the CPU 72 in the controller 70 executes the routine. The timing of the pressing of the test button 84*a* by the user may be at the moment when the assembling of finished element members into the ink-jet printer 10 in the manufacturing process is completed. It is noted that the paper sheet S is not set on the ink-jet printer 10 when the test button 84*a* is pressed.

Once the routine starts, the CPU 72 drives the drive motor 33 to move the carriage 22 to the home position, and resets the position of the carriage 22 to zero (step S100). The CPU 72 then sets a counter n representing the order of FIG. 3 to the value 1 (step S100), enters the output voltage of the PW detector 46 while moving the carriage 22 in the main scan direction (step S120), and determines whether the right edge of a n-th test element member is detected or not (step S130). More specifically, if the test element member is the wiper member 49*a* (i.e., n=1), the right edge of the wiper member 49*a* is considered to be detected when the output voltage deceases and becomes equal to or lower than the threshold value Vref1. If the test element member is the platen 44 (i.e., n=2), the right edge of the platen 44 is considered to be detected when the output voltage decreases and becomes equal to or lower than the threshold value Vref2. If the test element member is the blotting member 48*a* (i.e., n=3), the right edge of the blotting member 48*a* is considered to be detected when the output voltage increases and becomes equal to or higher than the threshold value Vref3. If the test element member is the flushing member 42 (i.e., n=4), the right edge of the flushing member 42 is considered to be detected when the output voltage decreases and becomes equal to or lower than the threshold value Vref4. If it is determined in step S130 that the right edge of the n-th test element member has not been detected, processing returns to step S120. If the right edge of the n-th test element member is detected, the CPU 72 determines the horizontal position of the right edge of the n-th test element member in response to a signal from the linear encoder 25 (step S140). The CPU 72 determines whether the horizontal position of the right edge of the n-th test element member is out of the horizontal design basis range (step S150). As previously discussed with reference to FIG. 2, the horizontal design basis range is determined on a per test element member basis. If the answer to the determination in step S150 is affirmative, the CPU 72 stores on the RAM 74 the indication that the horizontal position of the right edge of the n-th test element member is out of the horizontal design basis range (step S160).

Subsequent to step S160 or if the answer to the determination in step S150 is non-affirmative, the CPU 72 determines the vertical position of the test element member based on the output voltage of the PW detector 46 observed when the right edge of the n-th test element member is detected (step S170). In accordance with the present embodiment, the correlation between the right edge of each test element member in the vertical direction and the output voltage of the PW detector 46 is empirically determined beforehand, and the determined correlation is stored in the form of a map, a table, or a function on the ROM 73. The vertical position of the n-th test element member is determined based on the output voltage of the PW detector 46 in accordance with the correlation. The CPU 72 then determines whether the vertical position of the n-th test element member falls out of the design basis range (step S180). The vertical design basis range is determined on a per test element member basis as illustrated in FIG. 2. If the answer to the determination in step S180 is affirmative, the CPU 72 stores on the RAM 74 an indication that the vertical position of the n-th test element member is out of the design basis range (step S190).

Subsequent to step S190 or if the answer to the determination in step S180 is non-affirmative, the CPU 72 determines whether the counter n reaches a maximum value (4 in this case) (step S200). If the counter n is yet to reach the maximum value, the CPU 72 increments the counter n by 1 (step S210), and then returns to step S120. If the counter n has reached the maximum value, the CPU 72 determines whether all the test element members exceed the design basis range in substantially the same direction to substantially the same degree (step S220). If the answer to the determination in step S220 is affirmative, the CPU 72 stores on the RAM 74 an indication that the mounting positions of the PW detector 46 and the carriage 22 are likely to be in error (step S230). This operation is performed because the affirmative answer to the determination in step S220 can mean that the mounting positions of the PW detector 46 and the carriage 22 are in error with the remaining test elements mounted to within the design basis range. The affirmative answer to the determination in step S220 can also mean that the test element members exceed the design basis range in substantially the same direction to substantially the same degree. Subsequent to step S230 or if the answer to the determination in step S220 is non-affirmative, the CPU 72 moves the carriage 22 back to the home position (step S240). The CPU 72 displays the determination results on the liquid-crystal display 82 of the operation panel 80 (step S250). The routine thus ends.

Figures 5, 6:
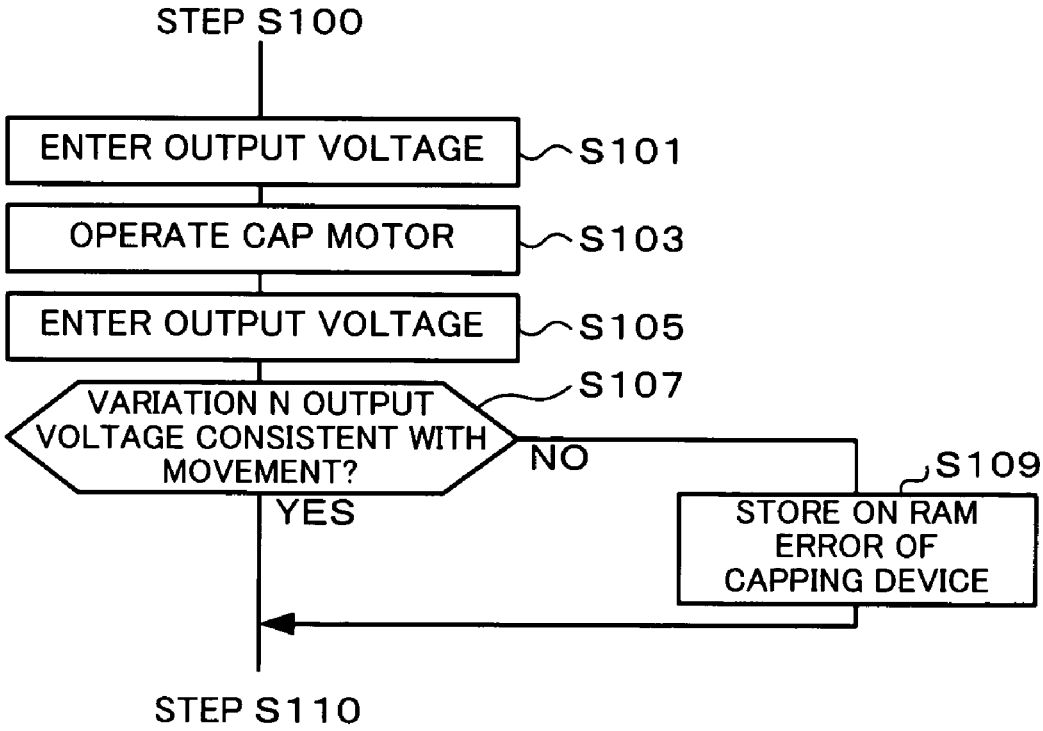
FIG. 5 illustrates an image of determination results displayed on a liquid-crystal display 82.
FIG. 6 is a flowchart illustrating a process of determining whether a cap motor malfunctions or not.

FIG. 5 illustrates an example of the determination results displayed on the liquid-crystal display 82 of the operation panel 80. "Passed" means that the mounting position falls within the design basis range and "failed" means that the mounting position falls out of the design basis range. In the mounting error determination routine, the test element member having the horizontal position thereof stored on the RAM 74 as falling out of the design basis range is displayed as the main scan direction as "failed," and the test element member having the vertical position thereof stored on the RAM 74 as falling out of the design basis range is displayed as the up-down direction as "failed." The other test element members are determined as being "passed." Referring to FIG. 5, the wiper member 49*a*, the blotting member 48*a*, and the flushing member 42 fall within the horizontal design basis range and the vertical design basis range. The platen 44 falls out of the horizontal design basis range but within the vertical design basis range. If the indication that the mounting positions of the PW detector 46 and the carriage 22 are likely to be in error is stored on the RAM 74, the message to that effect is displayed on the bottom display column below the determination results. If such an indication is not stored on the RAM 74, the indication that the mounting positions of the PW detector 46 and the carriage 22 are likely to be normal is displayed on the bottom display column below the determination results as illustrated in FIG. 5. The user can know the determination results of the mounting positions of the test element members and can thus know that it is necessary that a test element member falling out of the design basis range be re-mounted. Referring to FIG. 5, the platen 44 needs re-mounting.

Here, the relationship between the elements of the embodiments and those of this invention will be described. The print head 24 corresponds to the ejection module, the paper sheet S corresponds to the target, the PW detector 46 corresponds to the edge detection module, the carriage 22 corresponds to the carriage module, the reference information 73*a* corresponds to the information relating to the design basis range, the ROM 73 corresponds to the memory module, and the controller 70 corresponds to the determination module. The main scan direction corresponds to the predetermined direction, the up-down direction corresponds to the direction substantially perpendicular to the predetermined direction, the liquid-crystal display 82 corresponds to the notification module, and the cap motor and the wiper motor correspond to the lifting module.

When the test button 84*a* in the ink-jet printer 10 described above is pressed, the PW detector 46 for detecting the edge of the paper sheet S is used to determine whether the mounting position of a test element member falls within the design basis range. Whether the mounting position of the test element member falls within the design basis range is thus determined without using any dedicated mechanism. The controller 70 determines the position of the right edge of the test element member from the output voltage of the PW detector 46 and the position of the carriage 22 read by the linear encoder 25, and then determines whether the position of the right edge is out of the horizontal design basis range. The controller 70 can thus recognize a positional error of the test element member in the main scan direction. The controller 70 further determines the vertical position from the output voltage of the PW detector 46 and thus determines whether the vertical position is out of the vertical design basis range. The controller 70 can thus recognize a positional error of the test element member in the up-down direction. The controller 70 displays the determination results on the liquid-crystal display 82, thereby causing the user to recognize the error of the mounting position of the test element member. If all the test element members are out of the design basis range in substantially the same direction to substantially the same degree, the controller 70 displays on the liquid-crystal display 82 the indication that the mounting positions of the PW detector 46 and the carriage 22 are likely to be in an error. Whether the mounting positions of the PW detector 46 and the carriage 22 are likely to be in an error is determined without using any dedicated mechanism.

The present invention is not limited to the above-described embodiments, and various changes may be possible to the above-described embodiments without departing from the scope of the present invention.

In the above-described embodiments, for example, the element members of the ink-jet printer 10 within the detection coverage range of the PW detector 46 are determined as to whether the mounting positions thereof fall within the design basis range. The moving element members of the ink-jet printer 10 may be determined as to whether they operate normally or not. More specifically, a process of FIG. 6 may be executed subsequent to step S100 of the mounting error determination routine illustrated in FIG. 4. FIG. 6 is a flowchart of the process of determining whether the cap motor of the capping unit 40 malfunctions or not. After step S100, the PW detector 46 remains over the capping unit 40. A cap 40*a* of the capping unit 40 remains at the lower position thereof. Subsequent to step S100, the CPU 72 enters the output voltage of the PW detector 46 (step S101), and then operates the cap motor of the capping unit 40 to lift up the cap 40*a* to the upper position thereof (step S103). The CPU 72 detect the output voltage of the PW detector 46 again (step S105). The CPU 72 then determines whether a change in the output voltage responsive to the startup of the cap motor is consistent with the movement of the cap 40*a* from the lower position to the upper position (step S107). If it is determined in step S107 that the change in the output voltage is consistent with the movement of the cap 40*a*, processing proceeds to step S110. If it is determined in step S107 that the change in the output voltage is not consistent with the movement of the cap 40*a*, the controller 70 stores an indication of an error of the capping unit 40 onto the RAM 74 (step S109). Processing then proceeds to step S110. When the determination results are displayed in step S250, the indication of the error of the capping unit 40, if stored on the RAM 74, is also displayed together. One display example on the liquid-crystal display 82 is illustrated in FIG. 7. In this way, whether the cap motor malfunctions or not is determined without using any dedicated mechanism. Similarly, the wiper motor of the wiper unit 49 may be checked as to whether the wiper motor malfunctions or not.

In accordance with the above-described embodiments, the vertical position of the test element member is measured from the output voltage of the PW detector 46, and the measured vertical position is compared with the vertical design basis range represented in coordinates to determine whether the vertical position of the test element member is out of the vertical design basis range. Alternatively, the output voltage of the PW detector 46 may be compared with the vertical design basis range represented in voltage to determine whether the vertical position of the test element member is out of the vertical design basis range.

In accordance with the above-described embodiments, the mounting position in the main scan direction and mounting position in the up-down direction are compared with the design basis range. Alternatively, the mounting position in one direction only may be compared with the design basis range.

In accordance with the above-described embodiments, the image of the determination results is displayed on the liquid-crystal display 82. The determination results may be presented in the form of an audio output from a loudspeaker (not shown) in addition to or instead of displaying the image of the determination results on the liquid-crystal display 82.

In accordance with the above-described embodiments, the indication that the horizontal position of the test element member is out of the design basis range is stored on the RAM 74 in step S160 of the mounting error determination routine and the indication that the vertical position of the test element member is out of the design basis range is stored on the RAM 74 in step S190 of the mounting error determination routine. In addition to or instead of these operations, a displacement direction and a displacement amount may be stored. The displacement direction and the displacement amount stored on the RAM 74 may be displayed with the test element member associated therewith when the determination results are displayed on the liquid-crystal display 82 in step S250 of the mounting error determination routine. An adjustment mechanism for adjusting finely the position of each test element member both in the main scan direction and the up-down direction may be arranged. Subsequent to the end of the mounting error determination routine, the CPU 72 may control the adjusting mechanism to cancel the displacement amount.

In accordance with the above-described embodiments, the fluid ejection device is applied to the ink-jet printer 10. The present invention may be applicable to any type of fluid ejection device that ejects a fluid different from ink, a liquid-like body with functional material particles dispersed therewithin, or a liquid-like body such as a gel. The present invention may be applicable to a fluid ejection device that ejects a solid body that can be ejected as a fluid-like body. The present invention may be applicable to a fluid ejection device that ejects a fluid into which a material such as an electrode material or a color material may be dissolved. Such a material may be used in the manufacturing of a liquid-crystal display, an electroluminescence (EL) display, a plane emission display, or a color filter. The present invention may be applicable to a fluid ejection device that ejects a liquid-like body into which such a material is dispersed. The present invention may be applicable to a fluid ejection device that is used as a precision pipet and ejects a fluid serving as a specimen. The present invention may also be applicable to a fluid ejection device that ejects a lubricant to a precision machine such as a watch or a camera, and a fluid ejection device that ejects onto a board a transparent resin liquid such as an ultraviolet curing resin for forming a miniature hemispherical lens (optical lens) for use as optical communication elements. The present invention is also applicable to a fluid ejection device that ejects an acid etchant or an alkaline etchant to etch a board. The present invention is also applicable to a fluid ejection device that ejects a gel or powder such as a toner.

The present specification contains the subject matter of Japanese Patent Application No. 2008-000093 filed in Japan on Jan. 4, 2008, the entire disclosed contents of the specification, drawings, and claims of which are incorporated herein by reference.

What is claimed is:

1. A fluid ejection device, comprising:

an ejection module for ejecting a fluid;

an optical sensor for detecting an edge of a target based on a variation in an output voltage obtained in response to a light level of a received reflected light which is emitted to the target on a platen under the optical sensor;

a carriage module for mounting the ejection module and the optical sensor and moving the ejection module and the optical sensor in a horizontal direction while causing the ejection module to eject the fluid onto the target;

a memory module for storing information regarding a design basis range of a mounting position in an up-down direction of a predetermined element member provided within a detection coverage area of the optical sensor; and a determination module for controlling the optical sensor and the carriage module to detect an edge of the element member when an instruction to measure the mounting position of the element member is issued, measuring the mounting position in the up-down direction of the element member based on the output voltage of the optical sensor changing with movement of the carriage module and determining, based on the measured mounting position and the information regarding the design basis range stored on the memory module, whether a mounting position in the up-down direction of the element member falls within the design basis range.

2. The fluid ejection device according to claim 1, wherein the memory module stores, as the information regarding the design basis range, information regarding the design basis range of the mounting position of the element member in the up-down direction, and the determination module measures the mounting position of the element member in the up-down direction based on the output voltage of the edge detection module and an amount of movement of the carriage module, and determines, based on the measured mounting position and the design basis range stored on the memory module, whether the mounting position of the element member falls within the design basis range.

3. The fluid ejection device according to claim 1, further comprising a notification module for notifying a user of the determination results of the determination module.

4. The fluid ejection device according to claim 1, wherein the determination module determines whether mounting positions of a plurality of element members fall within design basis ranges thereof, and determines that at least one of the mounting position of the carriage module and the mounting position of the edge detection module with respect to the carriage module is likely to fall out the design basis range if all the determined members are shifted out of the design basis range.

5. The fluid ejection device according to claim 1, further comprising:

lifting module for moving the element member in the up-down direction; and a fault determination module for outputting a command to the lifting module to move the element member in the up-down direction and determining that the lifting module malfunctions if the output of the edge detection module remains unchanged subsequent to the output of the command.

6. A mounting position determination method of a fluid ejection device including an ejection module for ejecting a fluid, an optical sensor for detecting an edge of a target on a platen based on a variation in an output voltage obtained in response to a light level of a received reflected light that is emitted to the target under the optical sensor, and a carriage module for mounting the ejection module and the optical sensor and moving the ejection module and the optical sensor in a horizontal direction while causing the ejection module to eject the fluid onto the target, the mounting position determination method comprising steps of:

controlling the optical sensor and the carriage module to detect an edge of a predetermined element member provided within a detection coverage area of the optical sensor when an instruction to measure a mounting position of the predetermined element member is issued; and measuring the mounting position in the up-down direction of the element member, based on the output voltage of the optical sensor changing with movement of the carriage and determining based on the measure mounting position and information regarding a design basis range of the mounting position of the element member read from memory module, whether the mounting position in the up-down direction of the element member falls within the design basis range.

* * * * *